US009193036B2

(12) United States Patent
Kanazawa et al.

(10) Patent No.: US 9,193,036 B2
(45) Date of Patent: Nov. 24, 2015

(54) ABRASIVE WATER-JET MACHINING DEVICE

(75) Inventors: Hiroyuki Kanazawa, Tokyo (JP); Yasuo Baba, Tokyo (JP)

(73) Assignees: MITSUBISHI HEAVY INDUSTRIES, LTD, Tokyo (JP); FLOW JAPAN CORPORATION, Tokyo (JP)

( * ) Notice: Subject to any disclaimer, the term of this patent is extended or adjusted under 35 U.S.C. 154(b) by 44 days.

(21) Appl. No.: 14/110,607

(22) PCT Filed: Apr. 9, 2012

(86) PCT No.: PCT/JP2012/059711

§ 371 (c)(1),
(2), (4) Date: Oct. 8, 2013

(87) PCT Pub. No.: WO2012/141143

PCT Pub. Date: Oct. 18, 2012

(65) Prior Publication Data

US 2014/0030963 A1 Jan. 30, 2014

(30) Foreign Application Priority Data

Apr. 13, 2011 (JP) ..... 2011-089300

(51) Int. Cl.
*B26F 3/00* (2006.01)
*B24B 49/02* (2006.01)
(Continued)

(52) U.S. Cl.
CPC . *B24C 9/00* (2013.01); *B24B 49/02* (2013.01); *B24C 1/045* (2013.01); *B24C 3/02* (2013.01);
(Continued)

(58) Field of Classification Search
CPC ..... B24C 1/04; B24C 3/02; B24C 3/065; B24C 3/08; B24C 3/12; B26F 3/00004; B26F 3/008; B24B 49/02
USPC ..... 451/2, 9, 10, 11, 38, 87
See application file for complete search history.

(56) References Cited

U.S. PATENT DOCUMENTS 2,985,050 A * 5/1961 Schwacha ..... 83/53
4,435,902 A 3/1984 Mercer et al.
(Continued)

FOREIGN PATENT DOCUMENTS

CN 87100891 9/1987
EP 0 520 907 12/1992
(Continued)

OTHER PUBLICATIONS

Written Opinion of the International Searching Authority issued May 1, 2012 in International Application No. PCT/JP2012/059711.
(Continued)

*Primary Examiner* — Eileen Morgan
(74) *Attorney, Agent, or Firm* — Wenderoth, Lind & Ponack, L.L.P.

(57) ABSTRACT

An abrasive water-jet machining device includes an abrasive nozzle assembly (11) that jets ultrahigh-pressure water mixed with an abrasive during a cutting process for cutting a workpiece (W) into a desired shape, a catcher cup (12) that collects the ultrahigh-pressure water jetted from the abrasive nozzle assembly (11), and a distance adjusting mechanism (13) that adjusts the distance between the abrasive nozzle assembly (11) and the catcher cup (12) so as to maintain a constant distance between the catcher cup (12) and the workpiece (W). The device increases the collection rate of the abrasive fluid when cutting a workpiece whose plate thickness changes in a longitudinal direction (vertical direction) and/or a width direction (horizontal direction).

5 Claims, 6 Drawing Sheets

(51) Int. Cl.

| | |
|---|---|
| ***B24C 3/02*** | (2006.01) |
| ***B24C 3/08*** | (2006.01) |
| ***B24C 9/00*** | (2006.01) |
| ***B24C 1/04*** | (2006.01) |
| ***B24C 7/00*** | (2006.01) |
| *B26D 5/00* | (2006.01) |

(52) U.S. Cl.

CPC ..... *B24C 3/08* (2013.01); *B24C 7/0076* (2013.01); *B26D 5/005* (2013.01); *B26F 3/008* (2013.01); *B26D 5/00* (2013.01)

(56) References Cited

U.S. PATENT DOCUMENTS

| | | | | |
|---|---|---|---|---|
| 4,669,229 | A * | 6/1987 | Ehlbeck | 451/39 |
| 4,799,415 | A * | 1/1989 | Gerdes | 83/177 |
| 4,827,679 | A * | 5/1989 | Earle, III | 451/40 |
| 4,864,780 | A * | 9/1989 | Ehlbeck et al. | 451/38 |
| 4,872,293 | A * | 10/1989 | Yasukawa et al. | 451/75 |
| 4,920,841 | A * | 5/1990 | Johnson | 83/177 |
| 4,937,985 | A * | 7/1990 | Boers et al. | 451/75 |
| 4,964,244 | A * | 10/1990 | Ehlbeck | 451/453 |
| 5,111,652 | A * | 5/1992 | Andre | 451/87 |
| 5,527,204 | A * | 6/1996 | Rhoades | 451/40 |
| 6,244,927 | B1 | 6/2001 | Zeng | |
| 7,052,378 | B2 * | 5/2006 | Tateiwa et al. | 451/87 |
| 7,059,940 | B2 * | 6/2006 | Seo et al. | 451/37 |
| 8,894,468 | B2 * | 11/2014 | Hashish et al. | 451/87 |
| 2007/0221023 | A1 | 9/2007 | Yoshida et al. | |
| 2009/0098810 | A1 * | 4/2009 | Mase | 451/88 |
| 2010/0122719 | A1 * | 5/2010 | Mase et al. | 136/244 |
| 2011/0020155 | A1 | 1/2011 | Reukers | |
| 2012/0184185 | A1 * | 7/2012 | Kanazawa et al. | 451/38 |

FOREIGN PATENT DOCUMENTS

| | | |
|---|---|---|
| EP | 0 985 491 | 3/2000 |
| EP | 1 522 391 | 4/2005 |
| JP | 1-103265 | 4/1989 |
| JP | 4-146080 | 5/1992 |
| JP | 5-12100 | 2/1993 |
| JP | 7-8158 | 3/1995 |
| JP | 2000-88559 | 3/2000 |
| JP | 2000-176840 | 6/2000 |
| JP | 2001-198830 | 7/2001 |
| JP | 2003-25021 | 1/2003 |
| JP | 2003-220428 | 8/2003 |
| JP | 2006-110697 | 4/2006 |
| JP | 2006-167461 | 6/2006 |
| JP | 2010-120134 | 6/2010 |
| KR | 10-2009-111645 | 10/2009 |

OTHER PUBLICATIONS

International Search Report issued May 1, 2012 in International Application No. PCT/JP2012/059711.

Office Action issued Jul. 18, 2014 in corresponding Korean patent application No. 2013-7026744 (with English translation).

Extended European Search Report issued Mar. 2, 2015 in corresponding European patent application No. 12771418.6.

Office Action issued Mar. 26, 2015 in corresponding Chinese patent application No. 201280015428.2 (with English translation).

Decision to Grant a Patent issued May 19, 2015 in corresponding Japanese patent application No. 2011-089300.

Decision to Grant a Patent issued May 29, 2015 in corresponding Korean patent application No. 2013-7026744.

* cited by examiner

ABRASIVE WATER-JET MACHINING DEVICE

BACKGROUND OF THE INVENTION

1. Technical Field

The present invention relates to an abrasive water-jet machining device.

2. Description of the Related Art

Abrasive water-jet machining devices disclosed in Japanese Unexamined Utility Model Application, Publication No. Hei 05-12100 (JP 05-12100) and U.S. Pat. No. 4,827,679, for example, have been known.

SUMMARY OF THE INVENTION

1. Technical Problem

Conventional water jet cutting devices disclosed in JP 05-12100 etc. are configured such that a constant space (distance) is always kept between a nozzle 14 (referred to as "abrasive nozzle assembly 11" in this specification) and a catcher 22 (referred to as "catcher cup 12" in this specification), specifically, such that the distance therebetween is always kept constant irrespective of the plate thickness (thickness) of a workpiece W to be cut.

Thus, when the workpiece W whose plate thickness changes in a longitudinal direction (vertical direction) and/or a width direction (horizontal direction) is cut by using the conventional water jet cutting devices disclosed in JP 05-12100 etc., the distance between a lower surface of the workpiece W and the catcher 22 is increased at a portion where the plate thickness is small. Therefore, an abrasive fluid (referred to as "ultrahigh-pressure water" in this specification) flowing from the lower surface of the workpiece W toward the catcher 22 is scattered in a conical pattern, decreasing the collection rate of the abarasive fluid, and thus there is a possibility that the workpiece W will be damaged by the scattered abrasive material (referred to as "abrasive" in this specification).

Furthermore, if the inner diameter of the catcher 22 is increased in order to prevent the workpiece W from being damaged by the scattered abrasive material, the catcher 22 is increased in size, and thus there is a possibility that the catcher 22 will collide with the lower surface of the workpiece W, damaging the workpiece W.

The present invention has been made in view of the above-described circumstances, and an object thereof is to provide an abrasive water-jet machining device capable of increasing the collection rate of an abrasive fluid when cutting a workpiece whose plate thickness changes in the longitudinal direction (vertical direction) and/or the width direction (horizontal direction) and improving the worker's working environment.

2. Solution to the Problem

In order to solve the above-described problem, the present invention employs the following solutions.

The present invention provides an abrasive water-jet machining device including: an abrasive nozzle assembly that jets ultrahigh-pressure water mixed with an abrasive during a cutting process for cutting a workpiece into a desired shape; a catcher cup that collects the ultrahigh-pressure water jetted from the abrasive nozzle assembly; and a distance adjusting mechanism that adjusts a distance between the abrasive nozzle assembly and the catcher cup so as to keep a constant distance between the catcher cup and the workpiece.

According to the abrasive water-jet machining device of the present invention, even if the thickness of the workpiece changes, it is possible to maintain a constant distance (the optimum distance) between the catcher cup and the workpiece according to the change in the thickness of the workpiece, thus facilitating the collection of the ultrahigh-pressure water containing the abrasive, and to produce a fine finish on the machined surface, thus eliminating the need for additional finishing work, thereby making it possible to improve the work efficiency.

Furthermore, because the ultrahigh-pressure water containing the abrasive is collected without being spilled, it is possible to increase the collection rate of the ultrahigh-pressure water, to prevent the workpiece from being damaged by the scattered abrasive, and to improve the worker's working environment.

Furthermore, because the catcher cup is located at a position closer to the workpiece (at the optimum position), it is possible to reduce the sound level produced during the cutting work, thus improving the worker's working environment. Specifically, with the conventional technique disclosed in JP 05-12100, for example, nearby workers need to wear earplugs or the like because the sound (noise) level produced during the cutting work is about 100 db; however, with the abrasive water-jet machining device of the present invention, it becomes unnecessary to wear earplugs or the like, and the sound level is improved to a level allowing workers to have a conversation.

Furthermore, because the catcher cup 12 is located at a position closer to the workpiece W (at the optimum position) to achieve a reduction in size (diameter) of the catcher cup 12, it is possible to improve the ability to avoid interference with the workpiece W, thus making it possible to access a narrower space, compared with conventional techniques, to perform the cutting work.

Furthermore, by achieving a reduction in size (diameter) of the catcher cup 12, which is made of an expensive abrasion-resistant material, a reduction in cost can be achieved.

In the above-described abrasive water-jet machining device, it is more preferable that the abrasive nozzle assembly be fixed to one end of the distance adjusting mechanism, the catcher cup be fixed to the other end of the distance adjusting mechanism, and the distance adjusting mechanism, the abrasive nozzle assembly, and the catcher cup be configured as one unit.

According to this abrasive water-jet machining device, the distance adjusting mechanism, the abrasive nozzle assembly, and the catcher cup can be moved, as one unit, with respect to the workpiece. Specifically, the need to separately move the distance adjusting mechanism, the abrasive nozzle assembly, and the catcher cup is eliminated.

Thus, it is possible to provide the most-simple mechanism (configuration) for moving the distance adjusting mechanism, the abrasive nozzle assembly, and the catcher cup and to reduce the costs of equipment and maintenance checks.

The present invention provides a machine tool including the above-described abrasive water-jet machining device.

According to the machine tool of the present invention, even if the thickness of the workpiece changes, it is possible to maintain a constant distance (the optimum distance) between the catcher cup and the workpiece according to the change in the thickness of the workpiece, thus facilitating the collection of the ultrahigh-pressure water containing the abrasive, and to produce a fine finish on the machined surface, thus eliminating the need for additional finishing work, thereby making it possible to improve the work efficiency.

Furthermore, because the ultrahigh-pressure water containing the abrasive is collected without being spilled, it is possible to increase the collection rate of the ultrahigh-pressure water, to prevent the workpiece from being damaged by the scattered abrasive, and to improve the worker's working environment.

Furthermore, because the catcher cup is located at a position closer to the workpiece (at the optimum position), it is possible to reduce the sound level produced during the cutting work, thus improving the worker's working environment. Specifically, with the conventional technique disclosed in JP 05-12100, for example, nearby workers need to wear earplugs or the like because the sound (noise) level produced during the cutting work is about 100 db; however, with the abrasive water-jet machining device of the present invention, it becomes unnecessary to wear earplugs or the like, and the sound level is improved to a level allowing workers to have a conversation.

Furthermore, because the catcher cup is located at a position closer to the workpiece (at the optimum position) to achieve a reduction in size (diameter) of the catcher cup, it is possible to improve the ability to avoid interference with the workpiece, thus making it possible to access a narrower space, compared with conventional techniques, to perform the cutting work.

Furthermore, by achieving a reduction in size (diameter) of the catcher cup, which is made of an expensive abrasion-resistant material, a reduction in cost can be achieved.

In the above-described machine tool, it is more preferable to further include a controller that stores a maximum machining speed corresponding to a material and a thickness of the workpiece, in the form of a database for each material and thickness of the workpiece, that compares data stored in the database with data about the material and the thickness of the workpiece to be cut, input before the cutting work, and that outputs a command signal for the machining speed so as to make the arm move at the maximum machining speed.

According to this machine tool, the maximum machining speed is selected by the controller, and the workpiece is cut at the maximum machining speed.

Thus, it is possible to cut the workpiece in the shortest amount of time, thus improving the work efficiency.

In the above-described machine tool, it is more preferable that the controller is configured to output a command signal to the arm so as to keep a constant distance between the abrasive nozzle assembly and the workpiece.

According to this machine tool, even if the thickness of the workpiece changes, it is possible to keep a constant distance (the optimum distance) between the abrasive nozzle assembly and the workpiece according to the change in the thickness of the workpiece, thus further facilitating the collection of the ultrahigh-pressure water containing the abrasive, and to produce a finer finish on the machined surface, thus making it possible to further improve the work efficiency.

Furthermore, because even more ultrahigh-pressure water containing the abrasive is collected without being spilled, it is possible to further increase the collection rate of the ultrahigh-pressure water and to further improve the worker's working environment.

3. Advantageous Effects of the Invention

According to the abrasive water-jet machining device of the present invention, an advantageous effect is afforded in that it is possible to increase the collection rate of an abrasive fluid when cutting a workpiece whose plate thickness changes in the longitudinal direction (vertical direction) and/or the width direction (horizontal direction) and to improve the worker's working environment.

DETAILED DESCRIPTION OF THE INVENTION

An abrasive water-jet machining device according to one embodiment of the present invention will be described below with reference to FIGS. 1 to 11.

Figure 1:
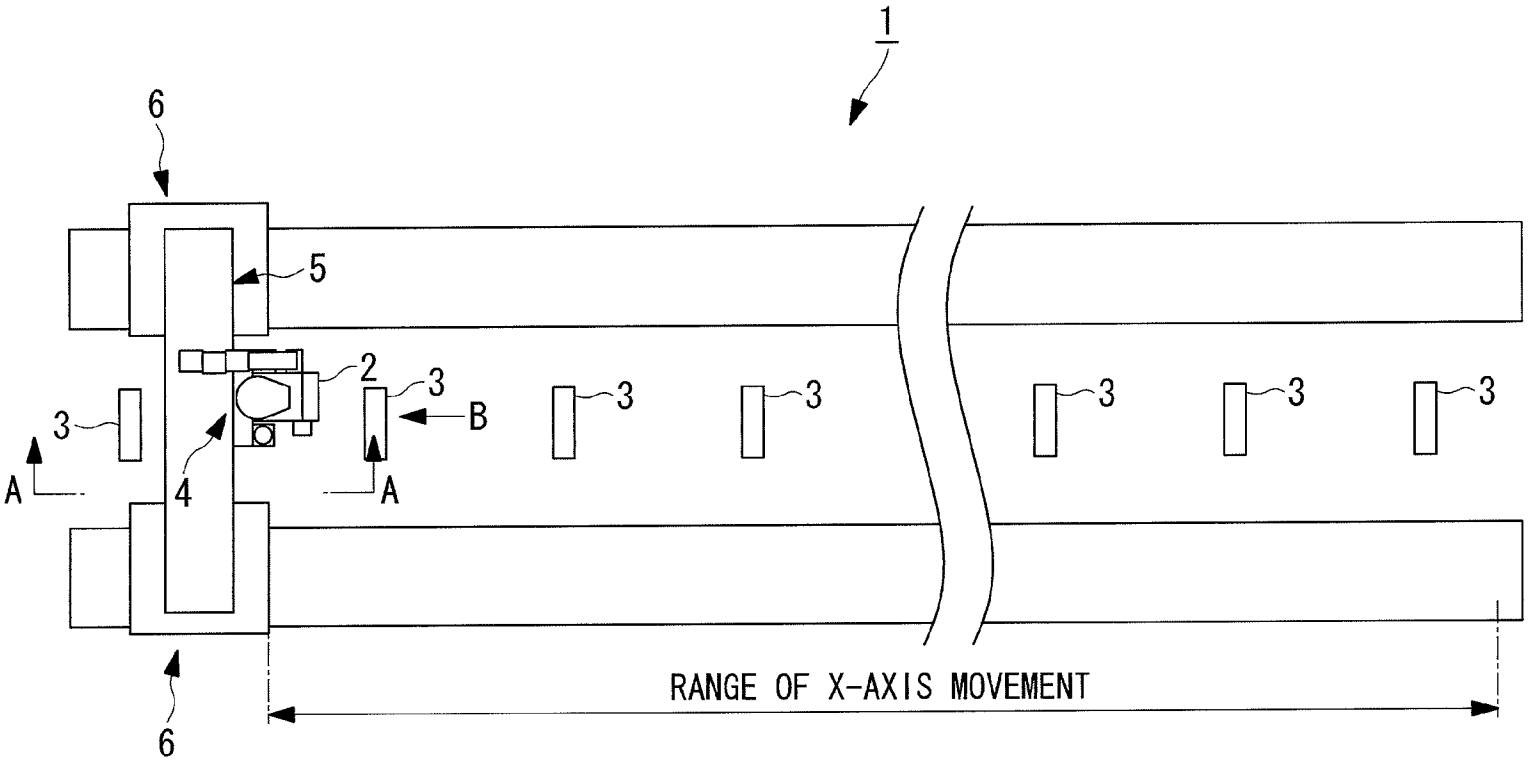
FIG. 1 is a plan view of a gantry type machine tool equipped with an abrasive water-jet machining device according to one embodiment of the present invention.
Figure 2:
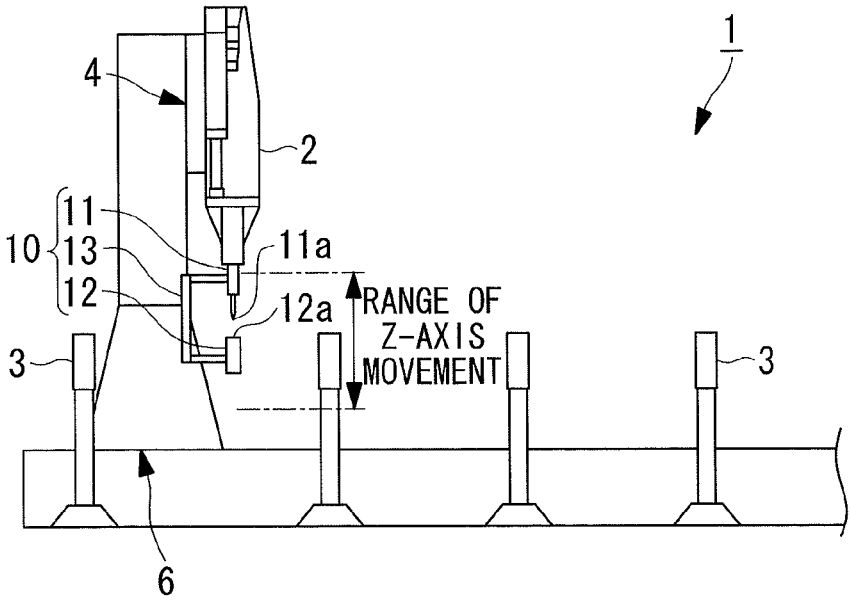
FIG. 2 is a view of the gantry type machine tool shown in FIG. 1, viewed along the arrow A in FIG. 1.
Figure 3:
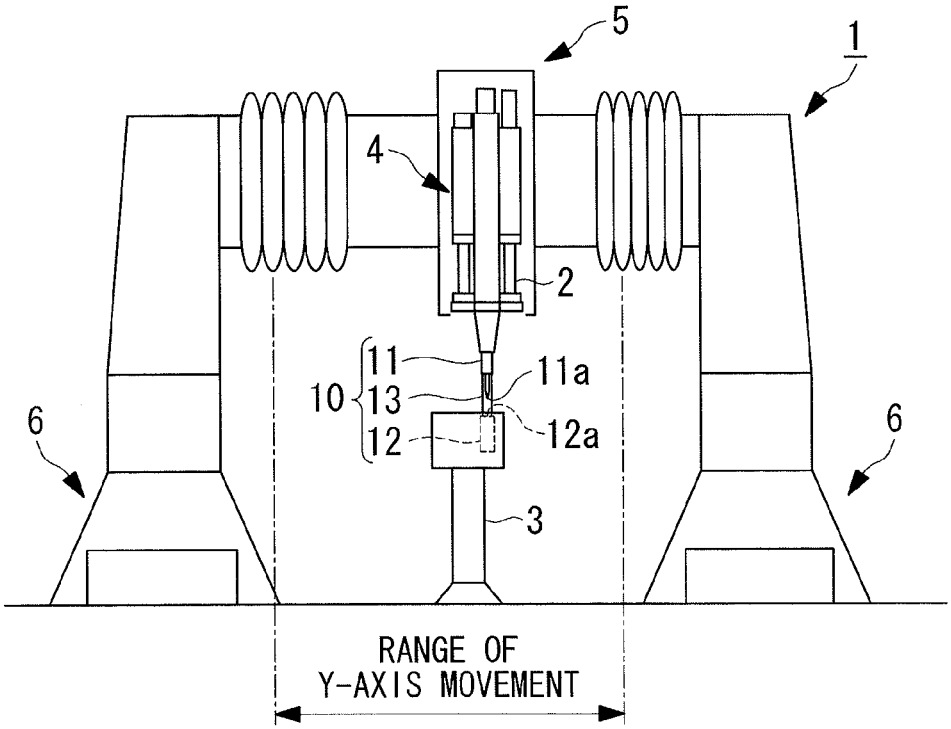
FIG. 3 is a view of the gantry type machine tool shown in FIG. 1, viewed along the arrow B in FIG. 1.

An abrasive water-jet machining device 10 of this embodiment is a device that is applied to a gantry type machine tool 1 shown in FIGS. 1 to 3, for example, and that cuts a workpiece W into a desired shape and is provided with an abrasive nozzle assembly 11, a catcher cup 12, and a distance adjusting mechanism 13 that adjusts the distance between the abrasive nozzle assembly 11 and the catcher cup 12.

As shown in FIGS. 1 to 3, the gantry type machine tool 1 includes a Z-axis-direction moving mechanism 4 that moves an arm 2, to which the abrasive water-jet machining device 10 is attached at a distal end thereof, in a Z-axis direction (the direction perpendicular to the plane in FIG. 1, the vertical direction in FIG. 2, and the vertical direction in FIG. 3) with respect to the workpiece W (see FIG. 4 etc.) placed on a plurality of workpiece fixing jigs 3, a Y-axis-direction moving mechanism 5 that moves the entire Z-axis-direction moving mechanism 4 in a Y-axis direction (the vertical direction in FIG. 1, the direction perpendicular to the plane in FIG. 2, and the horizontal direction in FIG. 3), and X-axis-direction moving mechanisms 6 that move the entire Z-axis-direction moving mechanism 4 and the entire Y-axis-direction moving mechanism 5 in an X-axis direction (the horizontal direction in FIG. 1, the horizontal direction in FIG. 2, and the direction perpendicular to the plane in FIG. 3).

As shown in FIGS. 2 and 3, the abrasive water-jet machining device 10 is attached to the distal end of the arm 2. Then, ultrahigh-pressure water mixed with an abrasive is jetted from an outlet 11*a* of the abrasive nozzle assembly 11 that faces an inlet 12*a* of the catcher cup 12, and the ultrahigh-pressure water containing the abrasive jetted from the outlet

Figure 4:
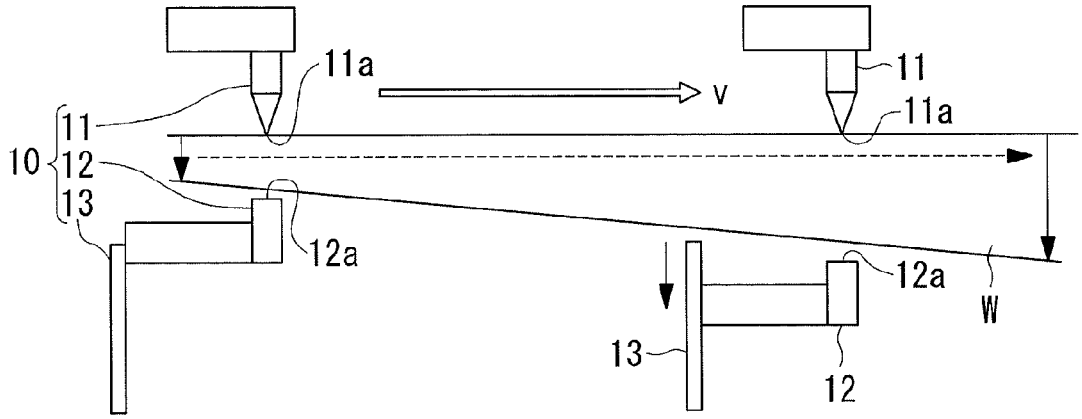
FIG. 4 is a view showing a main portion of the abrasive water-jet machining device according to the embodiment of the present invention, showing a state during cutting work.

11*a* of the abrasive nozzle assembly 11 is collected in the catcher cup 12 via the inlet 12*a*. Furthermore, as shown in FIG. 4, the abrasive water-jet machining device 10 of this embodiment is provided with the distance adjusting mechanism 13 that keeps a (substantially) constant distance Ln (see FIG. 5) between the abrasive nozzle assembly 11 and the workpiece W and a (substantially) constant distance L (see FIG. 5) between the catcher cup 12 and the workpiece W, according to the change in the plate thickness of the workpiece W even if the plate thickness of the workpiece W changes. A linear motion mechanism, such as an air cylinder (not shown), that can be moved in directions for moving the catcher cup 12 closer to and away from the abrasive nozzle assembly 11, that has the abrasive nozzle assembly 11 fixed to one end thereof, and that has the catcher cup 12 fixed to the other end thereof is employed as the distance adjusting mechanism 13.

Figure 5:
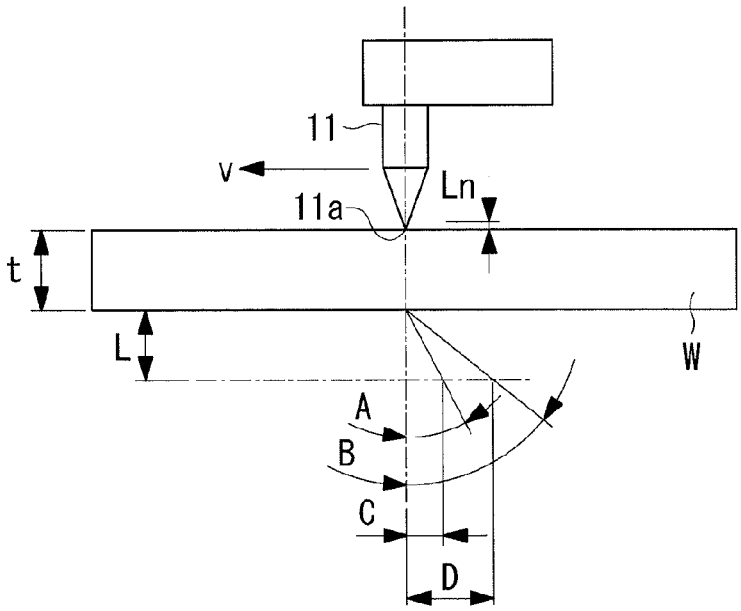
FIG. 5 is a view showing the main portion of the abrasive water-jet machining device according to the embodiment of the present invention, showing how a cutting experiment is conducted.

Here, the (maximum) machining speed (tool feed speed: tool movement speed) v and the distance d between the outlet 11*a* of the abrasive nozzle assembly 11 and the inlet 12*a* of the catcher cup 12, specifically, Ln (the distance between the outlet 11*a* of the abrasive nozzle assembly 11 and the workpiece W)+t (the thickness of the workpiece W)+L (the distance between the workpiece W and the inlet 12*a* of the catcher cup 12) shown in FIG. 5, are automatically controlled by a controller (not shown) during the cutting work. Specifically, the controller stores the machining speed v corresponding to the material and the thickness t of the workpiece W and stores the (optimum) distance Ln and the (optimum) distance L corresponding to the material of the workpiece W, in the form of a database for each material and thickness t of the workpiece W. The controller compares data stored in the form of the database with data about the material and the thickness t of the workpiece W that is input before the cutting work, outputs a command signal (control signal) for the machining speed v to the Y-axis-direction moving mechanism 5 and the X-axis-direction moving mechanisms 6, and outputs a command signal (control signal) for the distance Ln and the distance L corresponding to the material of the workpiece W to the Z-axis-direction moving mechanism 4 and the distance adjusting mechanism 13.

Note that, among the pieces of data stored in the controller in the form of the database, the machining speed v for the cutting work is calculated in advance for each material and thickness t of the workpiece W through a cutting experiment performed for calculating the machining speed v that satisfies a required (desired) roughness (accuracy) Ra.

Figure 6:
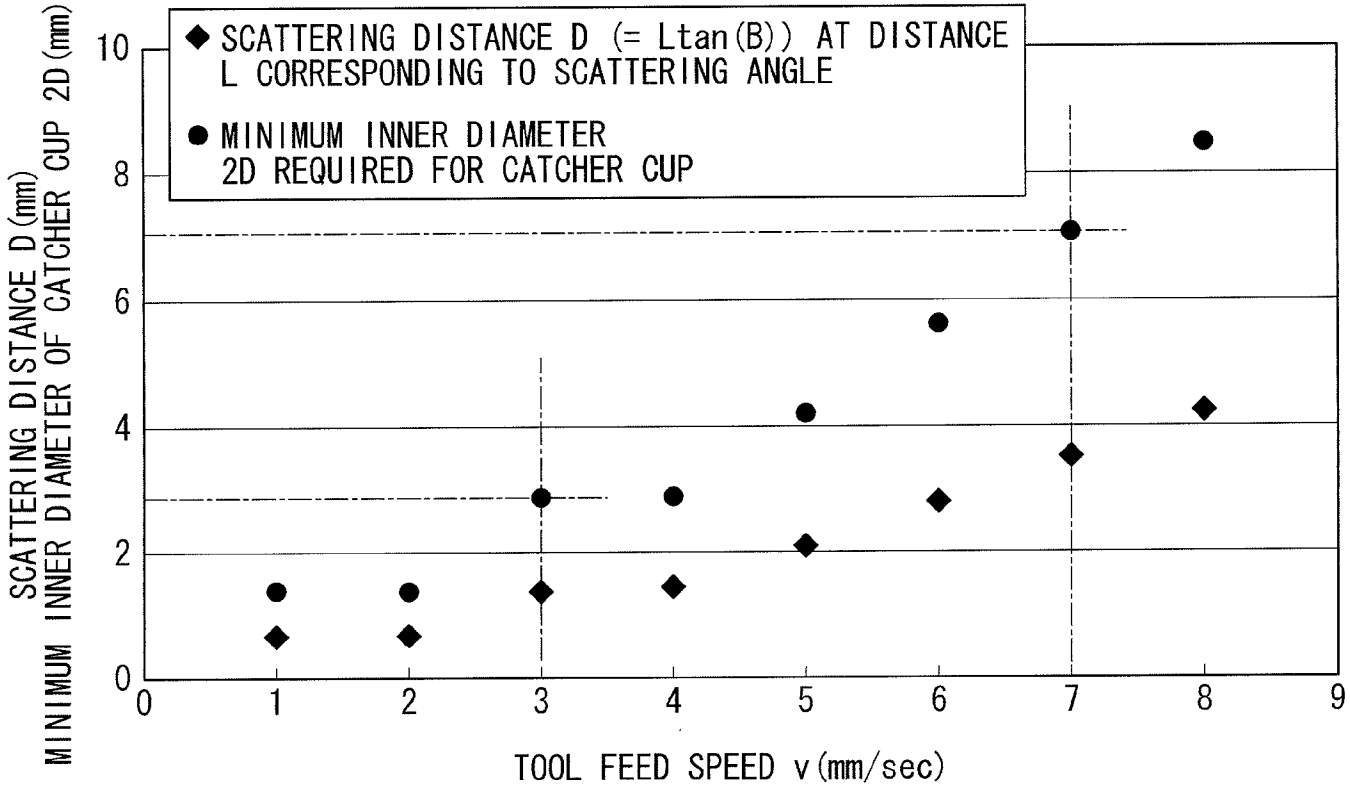
FIG. 6 is a diagram showing the results obtained through the cutting experiment.

Furthermore, in this cutting experiment, the scattering angle of ultrahigh-pressure water jetted from a lower surface of the workpiece W, indicated by reference symbol B in FIG. 5, is measured (gauged), and the scattering distance (=L tan B) of the ultrahigh-pressure water jetted from the lower surface of the workpiece W, indicated by reference symbol D in FIG. 5, is calculated from the obtained scattering angle B, thus obtaining measurement results indicated by solid squares in FIG. 6. Note that the cutting experiment of this embodiment was conducted on the condition that L=20 mm.

Then, the minimum inner diameters (=2 D) of the catcher cup 12 required for the catcher cup 12, indicated by solid circles in FIG. 6, are calculated from the measurement results indicated by the solid squares in FIG. 6.

Specifically, when the maximum machining speed v for the cutting work is 3 mm/sec, a catcher cup 12 having an inner diameter of 3 mm or more is adopted (selected), and, if the maximum machining speed v for the cutting work is 7 mm/sec, a catcher cup 12 having an inner diameter of 7 mm or more is adopted (selected).

Figure 7:
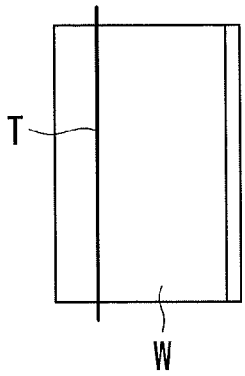
FIG. 7 is a plan view showing an example workpiece serving as an object to be cut.
Figure 8:
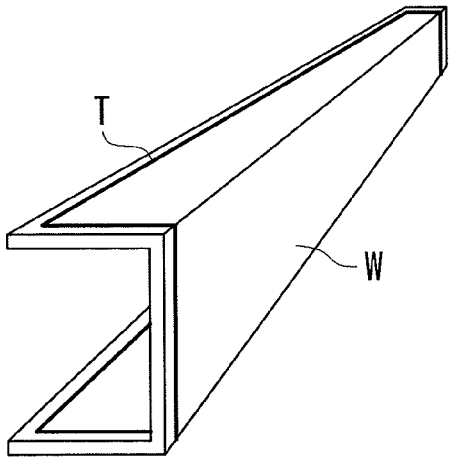
FIG. 8 is a perspective view showing an example workpiece serving as an object to be cut.
Figure 9:
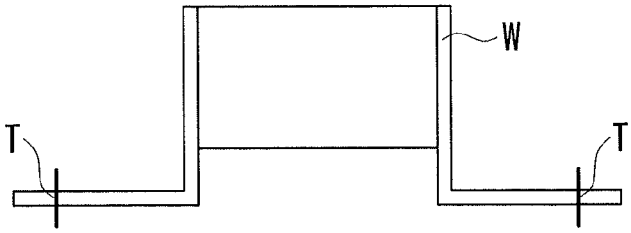
FIG. 9 is a front view showing an example workpiece serving as an object to be cut.
Figure 10:
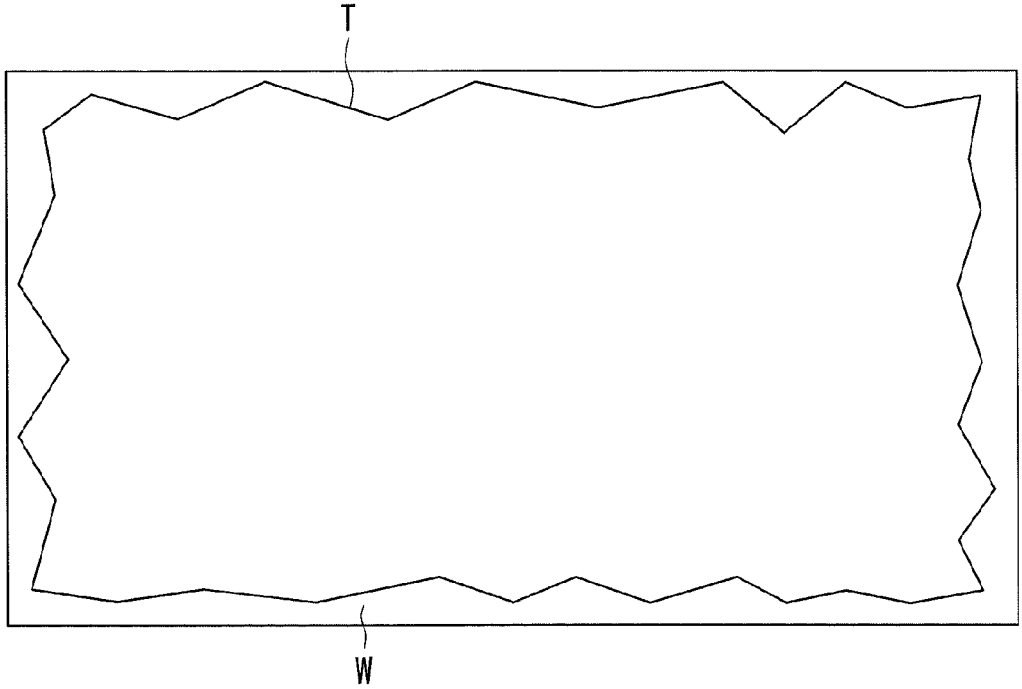
FIG. 10 is a plan view showing an example workpiece serving as an object to be cut.
Figure 11:
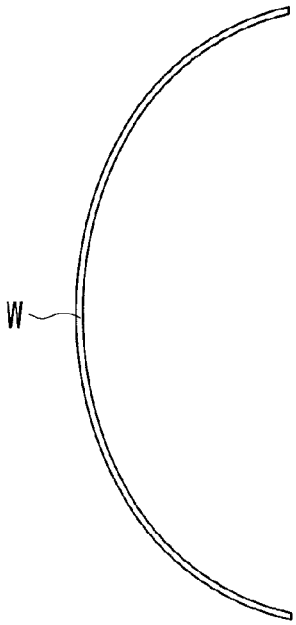
FIG. 11 is a front view showing an example workpiece serving as an object to be cut.

Furthermore, the distance Ln between the outlet 11*a* of the abrasive nozzle assembly 11 and the workpiece W is set to be as short as possible while taking into account the accuracy of position control of the abrasive nozzle assembly 11 performed by the Z-axis-direction moving mechanism 4, the shape of the abrasive nozzle assembly 11, and the shape of the workpiece W (for example, an L-shape shown in FIG. 7, a C-shape shown in FIG. 8, a double flanged shape shown in FIG. 9, a flat-plate shape shown in FIG. 10, or a curved shape shown in FIG. 11).

On the other hand, the distance L between the workpiece W and the inlet 12*a* of the catcher cup 12 is set to be as short as possible while taking into account the accuracy of position control of the catcher cup 12 performed by the distance adjusting mechanism 13, the shape of the catcher cup 12, and the shape of the workpiece W.

Note that solid lines indicated by reference symbol T in FIGS. 7 to 10 are specific examples of trim lines (cutting lines: cutting-plane lines).

According to the abrasive water-jet machining device 10 of this embodiment, even if the thickness of the workpiece W changes, it is possible to keep a constant distance (the optimum distance) between the catcher cup 12 and the workpiece W according to the change in the thickness of the workpiece W, thus facilitating the collection of the ultrahigh-pressure water containing the abrasive, and to produce a fine finish on the machined surface, thus eliminating the need for additional finishing work, thereby making it possible to improve the work efficiency.

Furthermore, because the ultrahigh-pressure water containing the abrasive is collected without being spilled, it is possible to increase the collection rate of the ultrahigh-pressure water, to prevent the workpiece W from being damaged by the scattered abrasive, and to improve the worker's working environment.

Furthermore, because the catcher cup 12 is located at a position closer to the workpiece W (at the optimum position), it is possible to reduce the sound level produced during the cutting work, thus improving the worker's working environment. Specifically, with the conventional technique disclosed in JP 05-12100, for example, nearby workers need to wear earplugs or the like because the sound (noise) level produced during the cutting work is about 100 db; however, with the abrasive water-jet machining device 10 of this embodiment, it becomes unnecessary to wear earplugs or the like, and the sound level is improved to a level allowing workers to have a conversation.

Furthermore, because the catcher cup 12 is located at a position closer to the workpiece W (at the optimum position) to achieve a reduction in size (diameter) of the catcher cup 12, it is possible to improve the ability to avoid interference with the workpiece W, thus making it possible to access a narrower space, compared with conventional techniques, to perform the cutting work.

Furthermore, by achieving a reduction in size (diameter) of the catcher cup 12, which is made of an expensive abrasion-resistant material, a reduction in cost can be achieved.

Furthermore, the machine tool of this embodiment is equipped with the above-described abrasive water-jet machining device.

According to the gantry type machine tool 1 of this embodiment, even if the thickness of the workpiece W changes, it is possible to keep a constant distance (the optimum distance) between the catcher cup 12 and the workpiece W according to the change in the thickness of the workpiece W, thus facilitating the collection of the ultrahigh-pressure water containing the abrasive, and to produce a fine finish on the machined surface, thus eliminating the need for additional finishing work, thereby making it possible to improve the work efficiency.

Furthermore, because the ultrahigh-pressure water containing the abrasive is collected without being spilled, it is possible to increase the collection rate of the ultrahigh-pressure water, to prevent the workpiece W from being damaged by the scattered abrasive, and to improve the worker's working environment.

Furthermore, because the catcher cup 12 is located at a position closer to the workpiece W (at the optimum position), it is possible to reduce the sound level produced during the cutting work, thus improving the worker's working environment. Specifically, with the conventional technique disclosed in JP 05-12100, for example, nearby workers need to wear earplugs or the like because the sound (noise) level produced during the cutting work is about 100 db; however, with the gantry type machine tool 1 of this embodiment, it becomes unnecessary to wear earplugs or the like, and the sound level is improved to a level allowing workers to have a conversation.

Furthermore, because the catcher cup 12 is located at a position closer to the workpiece W (at the optimum position) to achieve a reduction in size (diameter) of the catcher cup 12, it is possible to improve the ability to avoid interference with the workpiece W, thus making it possible to access a narrower space, compared with conventional techniques, to perform the cutting work.

Furthermore, by achieving a reduction in size (diameter) of the catcher cup 12, which is made of an expensive abrasion-resistant material, a reduction in cost can be achieved.

Furthermore, the gantry type machine tool 1 of this embodiment includes the controller (not shown), which stores the maximum machining speed corresponding to the material and the thickness of the workpiece W in the form of the database for each material and thickness of the workpiece W, which compares the data stored in the database with data about the material and the thickness of the workpiece W to be cut, input before the cutting work, and which outputs a command signal for the machining speed for making the arm 2 move at the maximum machining speed. Specifically, in the gantry type machine tool 1 of this embodiment, the maximum machining speed is selected by the controller, and the workpiece W is cut at the maximum machining speed.

Thus, it is possible to cut the workpiece W in the shortest amount of time, thus improving the work efficiency.

Furthermore, the gantry type machine tool 1 of this embodiment is configured to output a command signal from the controller to the arm 2 so as to maintain a constant distance between the abrasive nozzle assembly 11 and the workpiece W. Specifically, in the gantry type machine tool 1 of this embodiment, even if the thickness of the workpiece W changes, a constant distance (the optimum distance) is kept between the abrasive nozzle assembly 11 and the workpiece W according to the change in the thickness of the workpiece W.

Thus, it is possible to further facilitate the collection of the ultrahigh-pressure water containing the abrasive and to produce a finer finish on the machined surface, thus making it possible to further improve the work efficiency.

Furthermore, because even more ultrahigh-pressure water containing the abrasive is collected without being spilled, it is possible to further increase the collection rate of the ultrahigh-pressure water and to further improve the worker's working environment.

Note that the present invention is not limited to the above-described embodiment, and various changes and modifications can be made without departing from the scope of the present invention.

For example, in the above-described embodiment, although a description has been given of a specific example in which the abrasive water-jet machining device 10 of the present invention is applied to the gantry type machine tool 1, the abrasive water-jet machining device 10 of the present invention can be applied to any machine tool other than the gantry type machine tool 1 or to a machine tool such as a six-axis robot (vertical articulated robot).

REFERENCE SIGNS LIST

1 gantry type machine tool
2 arm
10 abrasive water-jet machining device
11 abrasive nozzle assembly
12 catcher cup
13 distance adjusting mechanism
L distance between catcher cup and workpiece
Ln distance between abrasive nozzle assembly and workpiece
W workpiece
t thickness of workpiece
v machining speed

The invention claimed is:

1. An abrasive water-jet machining device comprising:

an abrasive nozzle assembly that jets ultrahigh-pressure water mixed with an abrasive during a cutting process for cutting a workpiece into a desired shape;

a catcher cup that collects the ultrahigh-pressure water jetted from the abrasive nozzle assembly;

a controller that stores first data regarding a maximum machining speed corresponding to a material and a thickness of the workpiece, and second data regarding an optimum distance between the workpiece and the inlet of the catcher cup corresponding to the material of the workpiece, in the form of a database for each material and thickness of the workpiece; and a distance adjusting mechanism that adjusts a distance between the abrasive nozzle assembly and the catcher cup, wherein the controller outputs a command signal for the machining speed obtained by comparing the first data and the second data with data about the material and the thickness of the workpiece to be cut that is input before the cutting work to the distance adjusting mechanism, and the distance adjusting mechanism maintains the distance between the catcher cup and the workpiece, based on the command signal, at the optimum distance.

2. An abrasive water-jet machining device according to claim 1, wherein the abrasive nozzle assembly is fixed to one end of the distance adjusting mechanism, the catcher cup is fixed to the other end of the distance adjusting mechanism, and the distance adjusting mechanism, the abrasive nozzle assembly, and the catcher cup are configured as one unit.

3. A machine tool comprising an abrasive water-jet machining device according to claim 1 that is attached to a distal end of an arm.

4. A machine tool according to claim 3, wherein the controller outputs the command signal so as to make the arm move at the maximum machining speed.

5. A machine tool according to claim 4, wherein the controller is configured to output a command signal to the arm so as to keep a constant distance between the abrasive nozzle assembly and the workpiece.

* * * * *